US008674882B2

(12) United States Patent
Huang et al.

(10) Patent No.: US 8,674,882 B2
(45) Date of Patent: Mar. 18, 2014

(54) ANTENNA, COMPLEX ANTENNA AND RADIO-FREQUENCY TRANSCEIVER SYSTEM

(75) Inventors: Chang-Hsiu Huang, Hsinchu (TW); Cheng-Geng Jan, Hsinchu (TW); Chieh-Sheng Hsu, Hsinchu (TW)

(73) Assignees: Wistron NeWeb Corporation, Hsinchu Science Park, Hsinchu (TW); Cheng-Geng Jan, Hsinchu Science Park, Hsinchu (TW)

( * ) Notice: Subject to any disclaimer, the term of this patent is extended or adjusted under 35 U.S.C. 154(b) by 436 days.

(21) Appl. No.: 13/100,303

(22) Filed: May 4, 2011

(65) Prior Publication Data

US 2012/0214425 A1 Aug. 23, 2012

(30) Foreign Application Priority Data

Feb. 18, 2011 (TW) ..... 100105389 A

(51) Int. Cl.
*H01Q 1/38* (2006.01)

(52) U.S. Cl.
USPC ..... 343/700 MS; 343/836

(58) Field of Classification Search
USPC ..... 343/700 MS, 850, 853, 862, 863, 829, 343/830, 846, 848, 836
See application file for complete search history.

(56) References Cited

U.S. PATENT DOCUMENTS 5,404,145 A * 4/1995 Sa et al. ..... 343/700 MS

* cited by examiner

*Primary Examiner* — Karl D Frech
(74) *Attorney, Agent, or Firm* — Winston Hsu; Scott Margo

(57) ABSTRACT

An antenna for receiving and transmitting radio signals includes a ground metal plate, a first patch plate, a second patch plate, a first feed-in wire electrically connected to the first patch plate for transmitting radio signals, a second feed-in wire electrically connected to the second patch plate for transmitting radio signals, and an insulation fixing unit for fixing the ground metal plate, the first patch plate and the second patch plate, to ensure that the ground metal plate, the first patch plate and the second patch plate do not electrically contact to each other.

21 Claims, 21 Drawing Sheets

| Vertical polarization | Maximum gain | 3dB beam width | Front-to-back ratio | Co/Cx |
|---|---|---|---|---|
| 746(MHz) | 5.66 dBi | 96 deg | 19.4 dBi | 34.2 dBi |
| 756(MHz) | 6.05 dBi | 101 deg | 17.5 dBi | 41.2 dBi |
| 777(MHz) | 5.55 dBi | 101 deg | 12.4 dBi | 28.0 dBi |
| 787(MHz) | 6.08 dBi | 78 deg | 13.0 dBi | 28.2 dBi |
| Horizontal polarization | Maximum gain | 3dB beam width | Front-to-back ratio | Co/Cx |
| 746(MHz) | 5.68 dBi | 102 deg | 10.5 dBi | 29.6 dBi |
| 756(MHz) | 5.46 dBi | 112 deg | 10.8 dBi | 28.6 dBi |

FIG. 10

| Vertical polarization | Maximum gain | 3dB beam width | Front-to-back ratio | Co/Cx |
|---|---|---|---|---|
| 746(MHz) | 5.53 dBi | 100 deg | 12.7 dBi | 29.0 dBi |
| 756(MHz) | 6.02 dBi | 99 deg | 13.1 dBi | 26.6 dBi |
| 777(MHz) | 6.25 dBi | 94 deg | 12.1 dBi | 22.8 dBi |
| 787(MHz) | 5.90 dBi | 92 deg | 11.6 dBi | 23.3 dBi |
| Horizontal polarization | Maximum gain | 3dB beam width | Front-to-back ratio | Co/Cx |
| 746(MHz) | 5.19 dBi | 118 deg | 15.2 dBi | 31.9 dBi |
| 756(MHz) | 4.88 dBi | 116 deg | 14.4 dBi | 36.8 dBi |

FIG. 11

| Intersection point | Gain (dBi) |
|---|---|
| 1 | 5.1 |
| 2 | 5.1 |
| 3 | 5.0 |
| 4 | 4.8 |
| 5 | 4.7 |
| 6 | 4.9 |
| 7 | 5.0 |
| 8 | 5.1 |

| Intersection point | Gain (dBi) |
|---|---|
| 1 | 5.1 |
| 2 | 5.1 |
| 3 | 5.0 |
| 4 | 5.0 |
| 5 | 4.9 |
| 6 | 4.9 |
| 7 | 5.1 |
| 8 | 5.2 |

ANTENNA, COMPLEX ANTENNA AND RADIO-FREQUENCY TRANSCEIVER SYSTEM

BACKGROUND OF THE INVENTION

1. Field of the Invention

The present invention relates to an antenna, complex antenna and radio-frequency transceiver system, and more particularly, to an antenna, complex antenna and radio-frequency transceiver system capable of effectively increasing spatial efficiency, resonance bandwidth and variety for design, to adapt to multiple-input multiple-output (MIMO) applications.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, MIMO communication systems can employ techniques such as spatial multiplexing, beam forming, spatial diversity, pre-coding, etc. to further reduce signal interference and increase channel capacity.

As can be seen from the above, a prerequisite for implementing spatial multiplexing and spatial diversity in MIMO is to employ multiple sets of antenna to divide a space into many channels, in order to provide multiple antenna field patterns. Therefore, it is a common goal in the industry to design antennas that suit both transmission demands, as well as dimension and functionality requirements.

SUMMARY OF THE INVENTION

Therefore, present invention primarily provides an antenna, complex antenna and radio-frequency transceiver system.

The present invention discloses an antenna for receiving/transmitting radio signals, including a ground metal plate; a first patch plate; a second patch plate; a first feed-in wire, electrically connected to the first patch plate, for transmitting radio signals; a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other.

The present invention further discloses a complex antenna for receiving/transmitting radio signals, including a plurality of antennas, each antenna including a ground metal plate; a first patch plate; a second patch plate; a first feed-in wire, electrically connected to the first patch plate, for transmitting radio signals; a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other; wherein the ground metal plate of each of the plurality of antennas is electrically connected to the ground metal plate of another antenna.

The present invention further discloses a radio-frequency transceiver system for receiving/transmitting radio signals, including a complex antenna, comprising a plurality of antennas, each of the plurality of antennas including a ground metal plate; a first patch plate; a second patch plate; a first feed-in wire, electrically connected to the first patch plate, for transmitting radio signals; a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other; wherein the ground metal plate of each of the plurality of antennas is electrically connected to the ground metal plate of another antenna; and a radio-frequency signal processing module; and a switching circuit, electrically connected between the first feed-in wire, the second feed-in wire of each of the plurality of antennas and the radio-frequency signal processing module, for switching a connection between the radio-frequency signal processing module and the first feed-in wire or the second feed-in wire.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGS. 7 to 13 are schematic diagrams of characteristics of the complex antenna in FIG. 4.

DETAILED DESCRIPTION

Figure 1A:
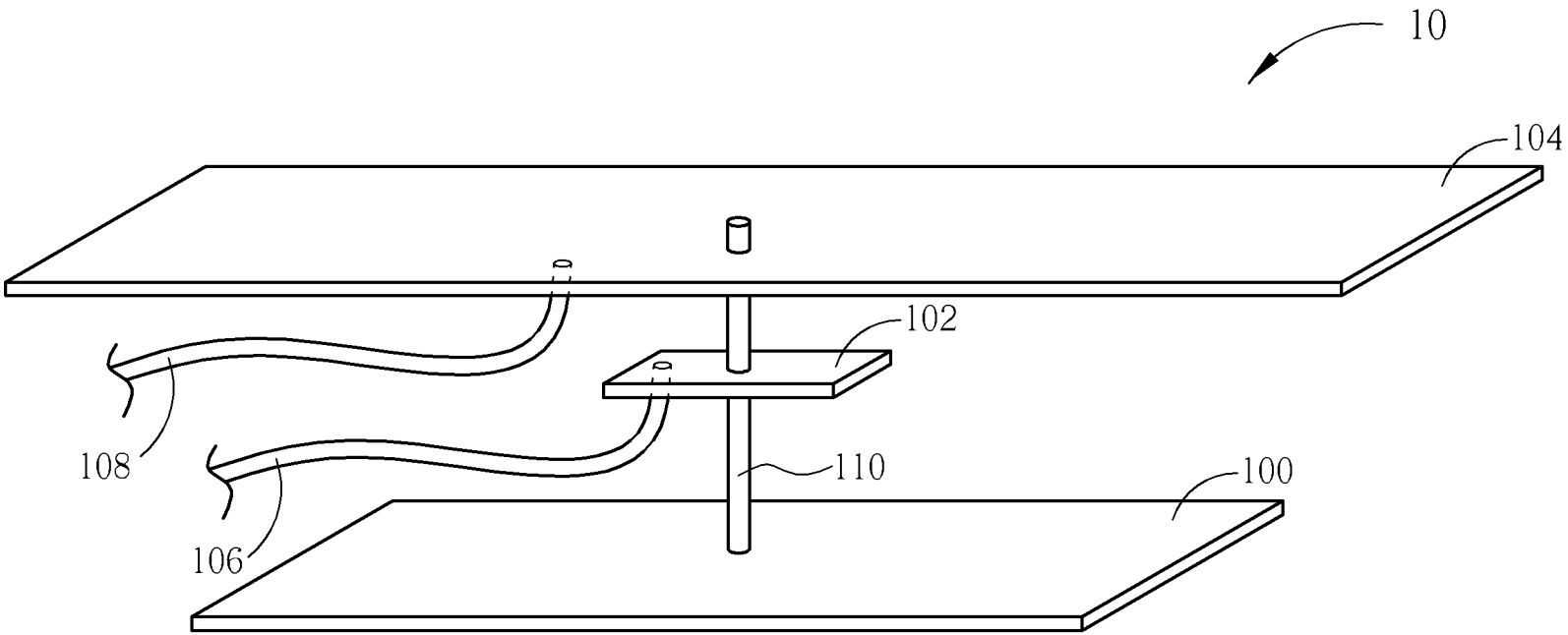
FIGS. 1A and 1B are oblique and lateral perspective schematic diagrams of an antenna, respectively, according to an embodiment of the present invention.
Figure 1B:
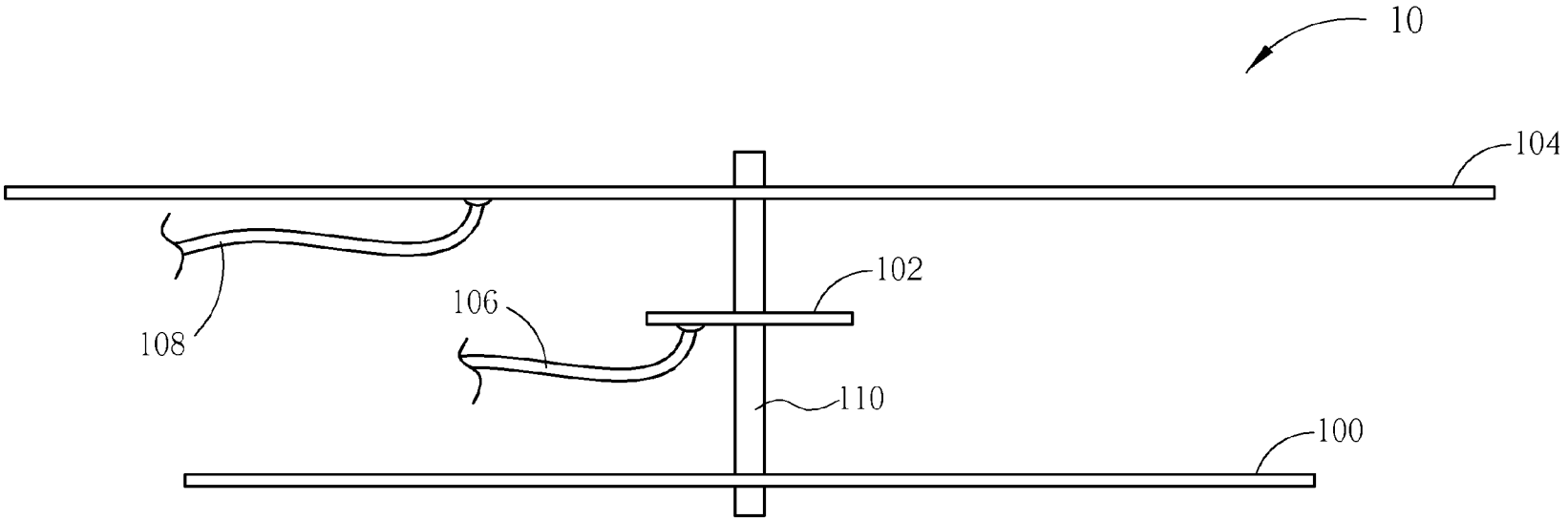

Please refer to FIGS. 1A and 1B, which are oblique and lateral perspective schematic diagrams of an antenna 10, respectively, according to an embodiment of the present invention. The antenna 10 is used for receiving/transmitting radio signals, and includes a ground metal plate 100, a first patch plate 102, a second patch plate 104, a first feed-in wire 106, a second feed-in wire 108 and an insulation fixing unit 110. As shown in FIGS. 1A and 1B, the insulation fixing unit 110 is used for fixing the ground metal plate 100, the first patch plate 102 and the second patch plate 104, such that they do not come in electrical contact with each other and form a multi-layer structure. The first feed-in wire 106 and the second feed-in wire 108 are electrically connected to the first patch plate 102 and the second patch plate 104, respectively, and are used for transmitting or receiving radio signals via the antenna 10.

Figure 2A:
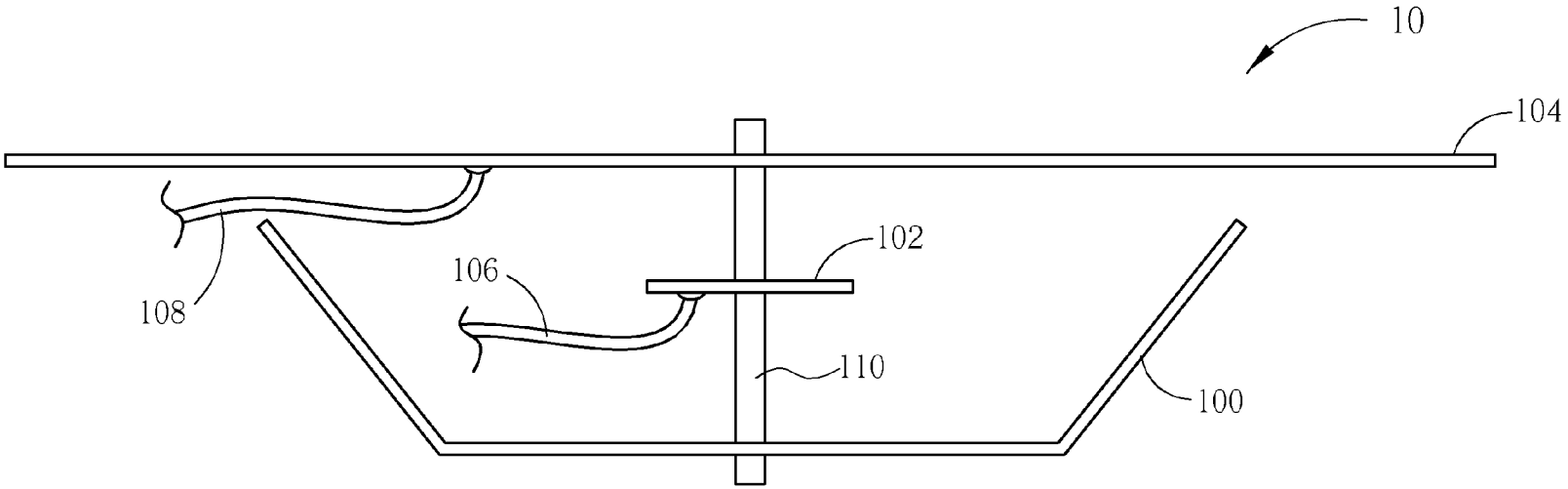
FIGS. 2A to 2E are embodiments of different variations of the antenna in FIG. 1A.
Figure 2B:
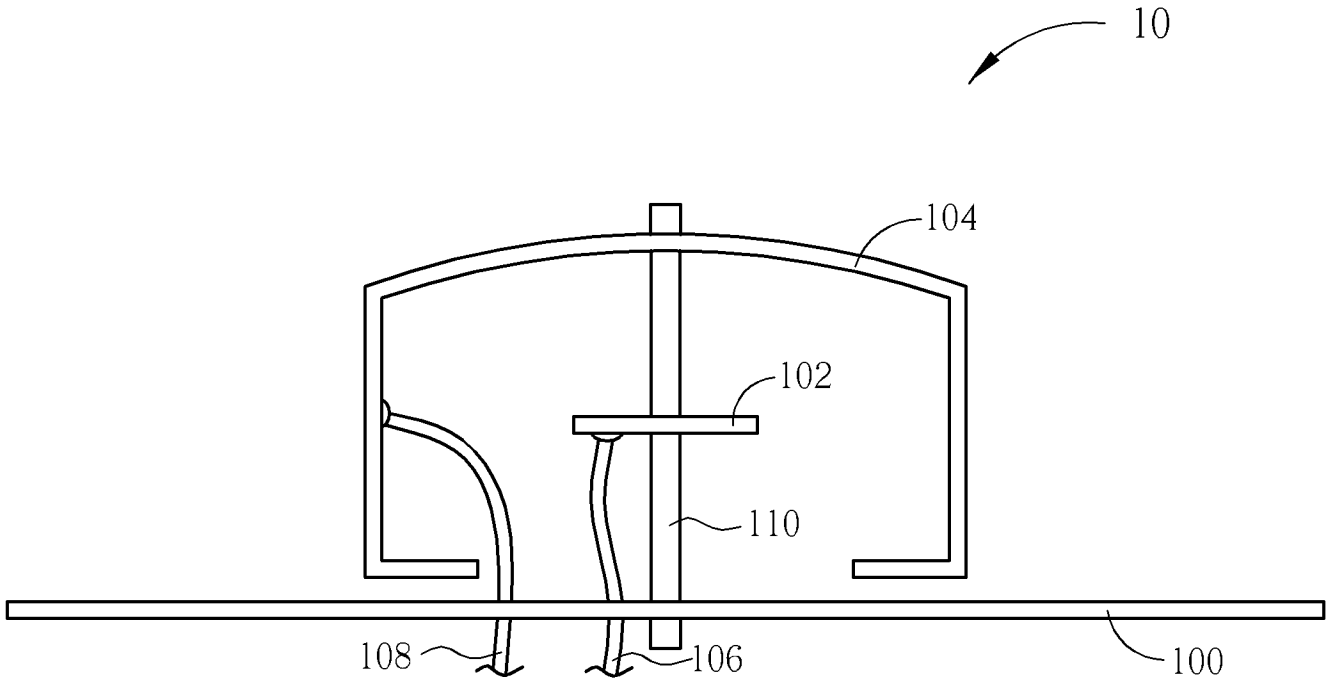

In the antenna 10, the first patch plate 102 and the second patch plate 104 are the main radiating bodies. Such multi-layered radiating body design effectively increases resonance bandwidth, increasing variety for design. More importantly, horizontal and vertical polarization is easily achievable with such a multi-layer fed design, as well as an improved isolation between the horizontal and vertical polarization. Note that, the antenna 10 in FIG. 1 is an embodiment of the present invention; suitable alterations and modifications may be made accordingly by those skilled in the art, and are not limited thereto. For example, dimensions, materials, or shapes of each individual component of the antenna 10 are related to a required transmission/reception signal frequency range or power, etc. For instance, as shown in FIG. 2A, in order to focus the wave beam within a range, the ground metal plate 100 may include at least a bend. Also, as shown in FIG. 2B, it is possible to reduce a space occupied by the second patch plate 104 (i.e. an area projected onto the ground metal plate 100) by incorporating at least a bend in the second patch plate 104, in order to reduce physical dimensions of the antenna 10. It is equally possible to adjust a shape of the first patch plate 102, similar to FIG. 2B. Alternatively, FIGS. 2A and 2B may be combined to get the best of both worlds, as shown in FIG. 2C.

Figure 2C:
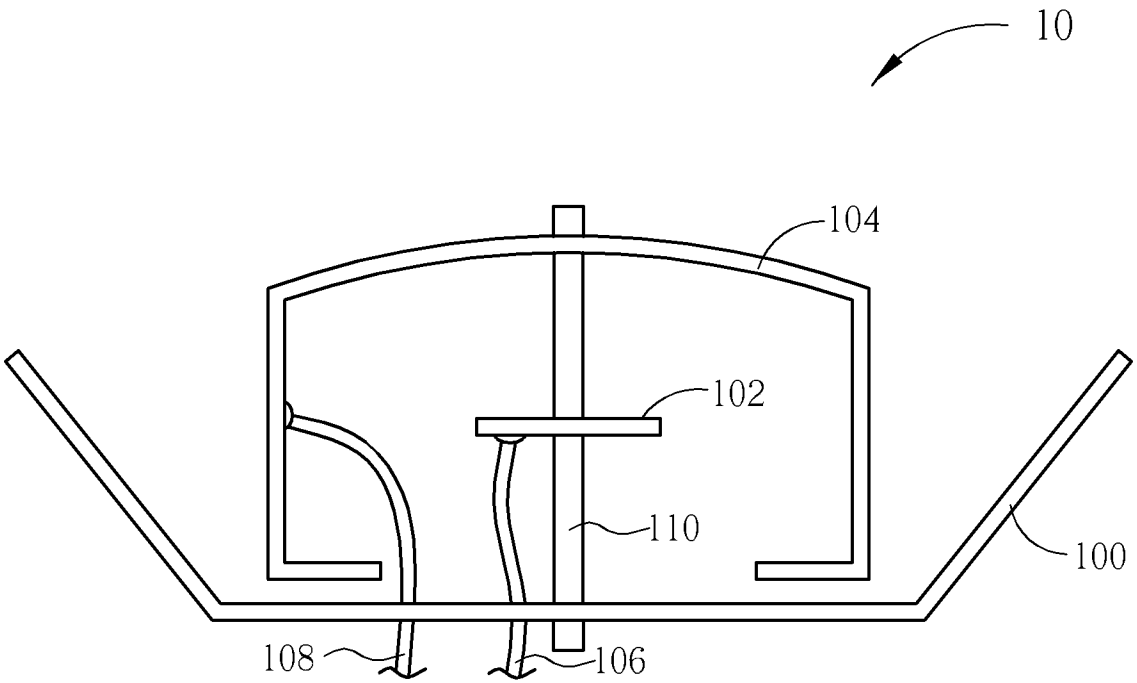
Figure 2D:
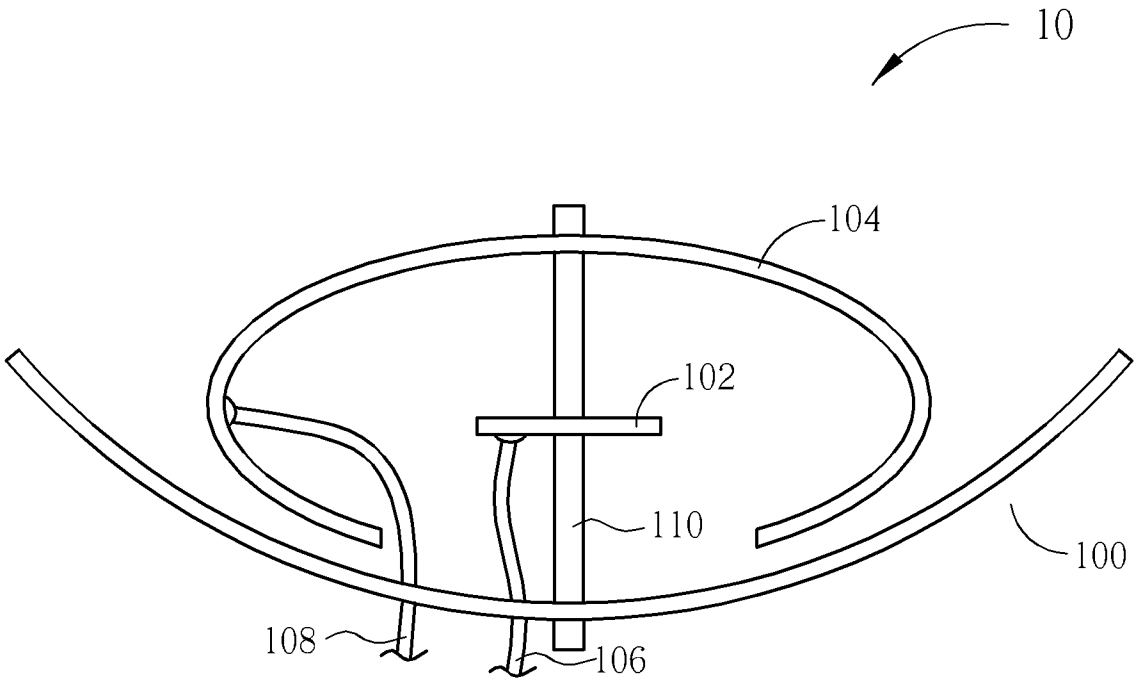
Figure 2E:
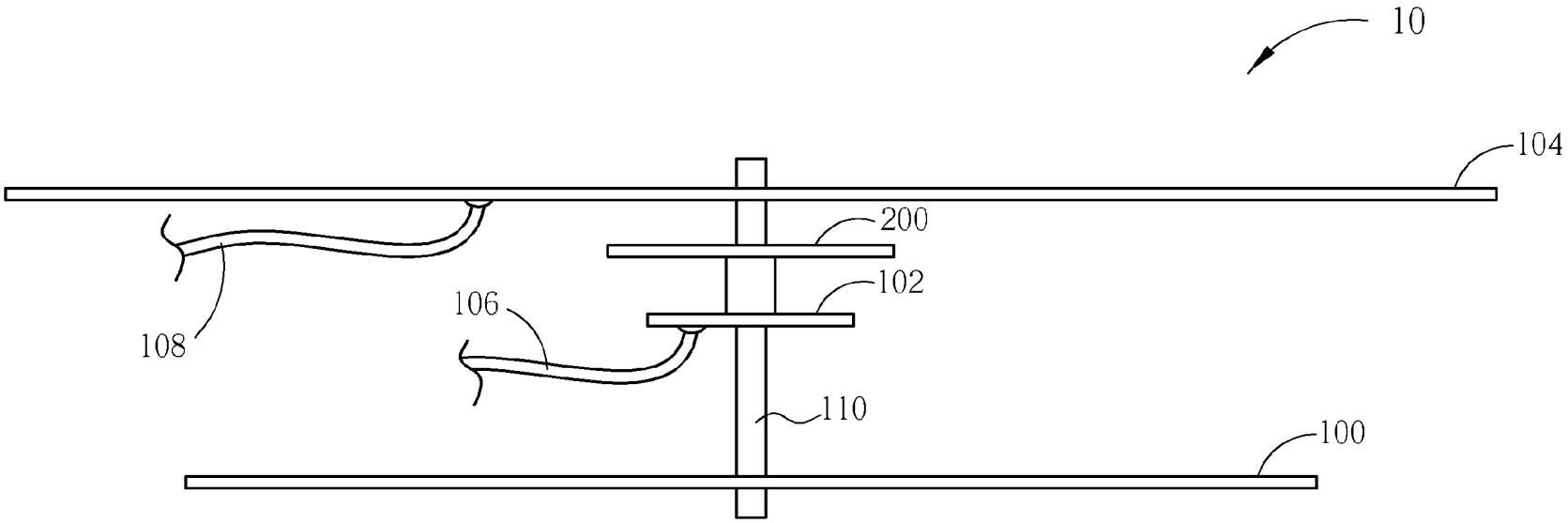

FIGS. 2A to 2C serve to illustrate how the ground metal plate 100, first patch plate 102 or second patch plate 104 may be adjusted in shapes. Note that, ways of adjustment are not limited thereto, providing that a normal operation of the antenna 10 is ensured. For instance, as shown in FIG. 2D, the ground metal plate 100 and the second patch plate 104 may be arc-shaped. Moreover, as shown in FIG. 2E, it is possible to further increase the resonance bandwidth by adding a third patch plate 200 between the first patch plate 102 and the second patch plate 104, and fixating with the insulation fixing unit 110. Additionally, wire lengths of the first feed-in wire 106 and the second feed-in wire 108 are not limited; preferably, the wire lengths should be related to a half wavelength of the radio signal to be transmitted.

Figure 3A:
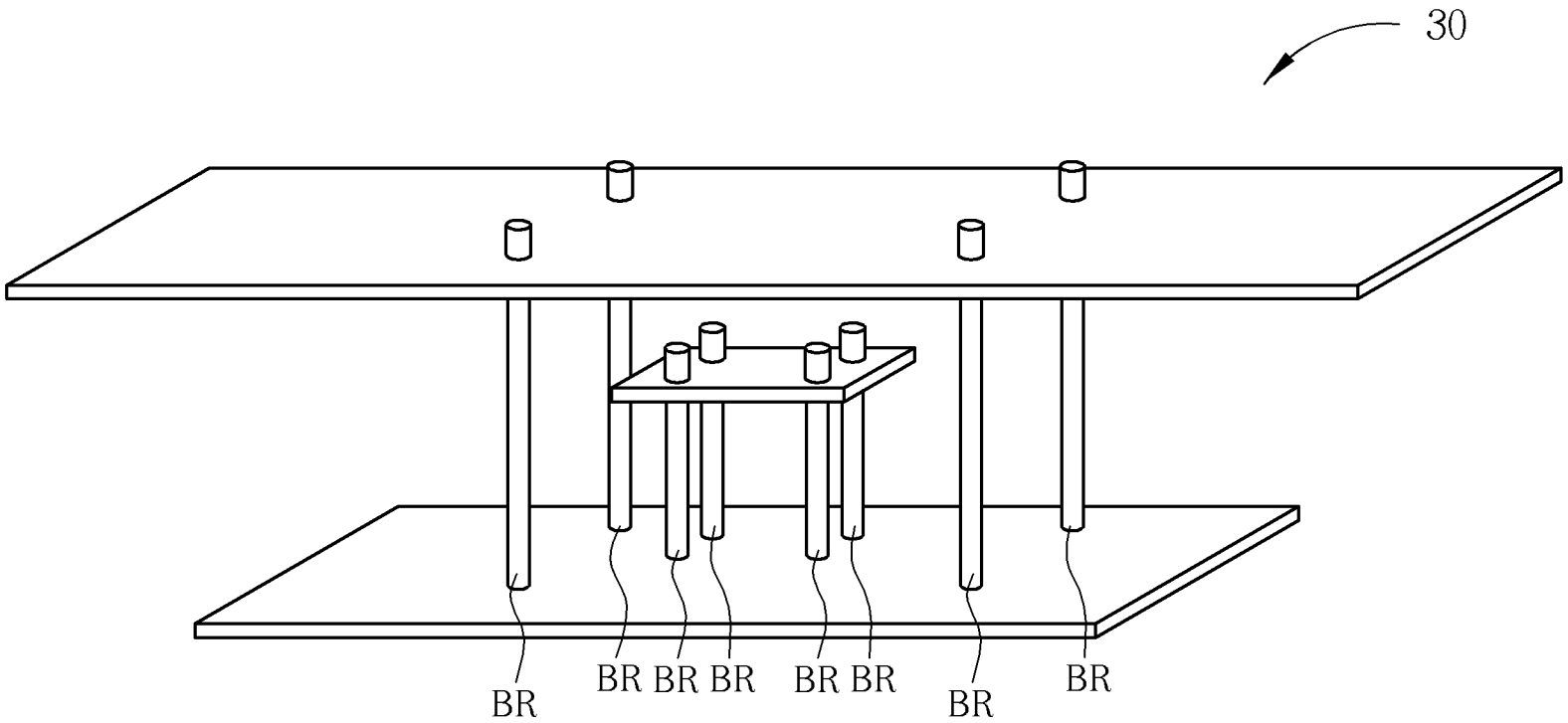
FIGS. 3A and 3B are oblique and lateral perspective schematic diagrams of an antenna according to an embodiment of the present invention, respectively.
Figure 3B:
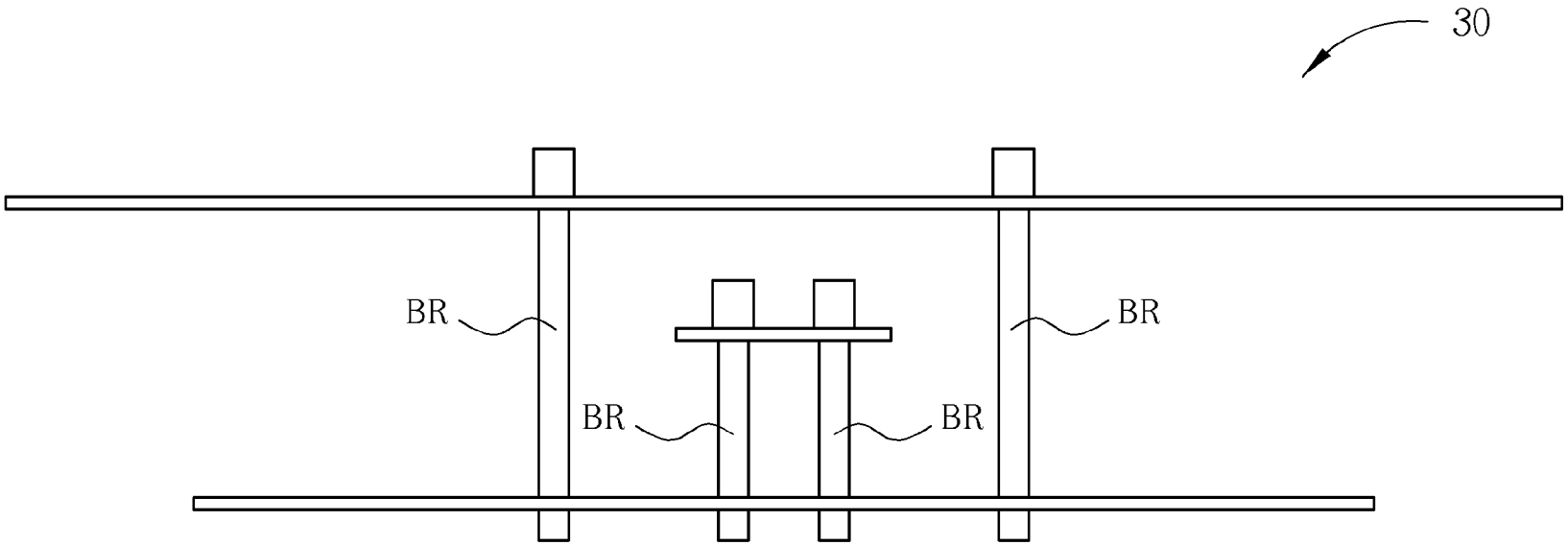

In FIG. 1 and FIG. 2A to FIG. 2E, the insulation fixing unit 110 is cylindrical-shaped; however, the shape is not limited thereto. The insulation fixing unit 110 may also be formed by multiple cylinders, providing that the ground metal plate 100, the first patch plate 102, the second patch plate 104, and the third patch plate 200 are fixated through insulated means. For example, please refer to FIGS. 3A and 3B, which are oblique and lateral perspective schematic diagrams of an antenna 30, respectively, according to an embodiment of the present invention. The antenna 30 has a same structure as the antenna 10 in FIGS. 1A and 1B; the difference is that the insulation fixing unit of the antenna 30 is formed by eight cylinders BR, which serve a same functionality as the insulation fixing unit 110 of antenna 10.

Figure 4:
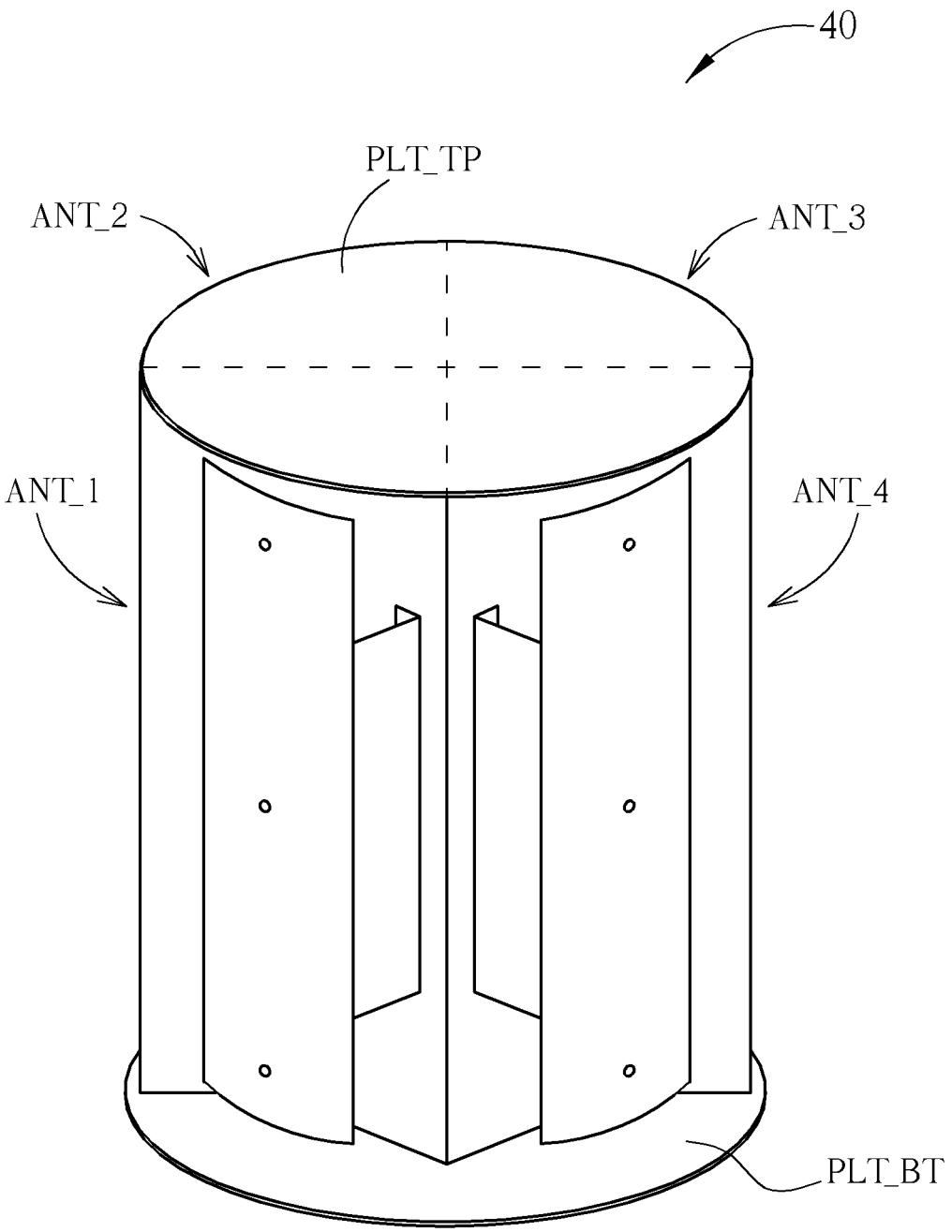
FIG. 4 is a schematic diagram of a complex antenna according to an embodiment of the present invention.
Figure 5A:
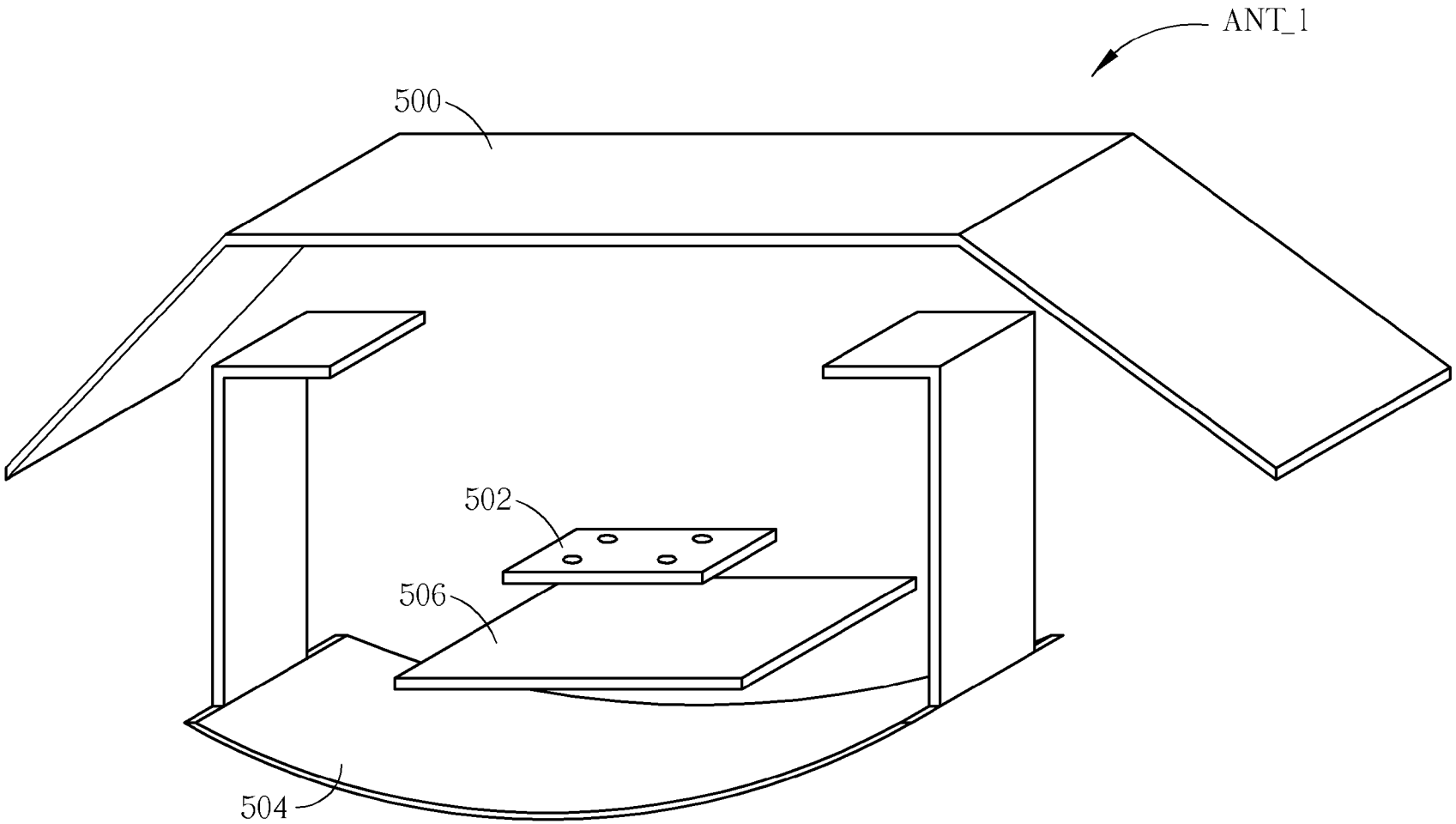
FIGS. 5A and 5B are schematic diagrams of an antenna in the complex antenna in FIG. 4.
Figure 5B:
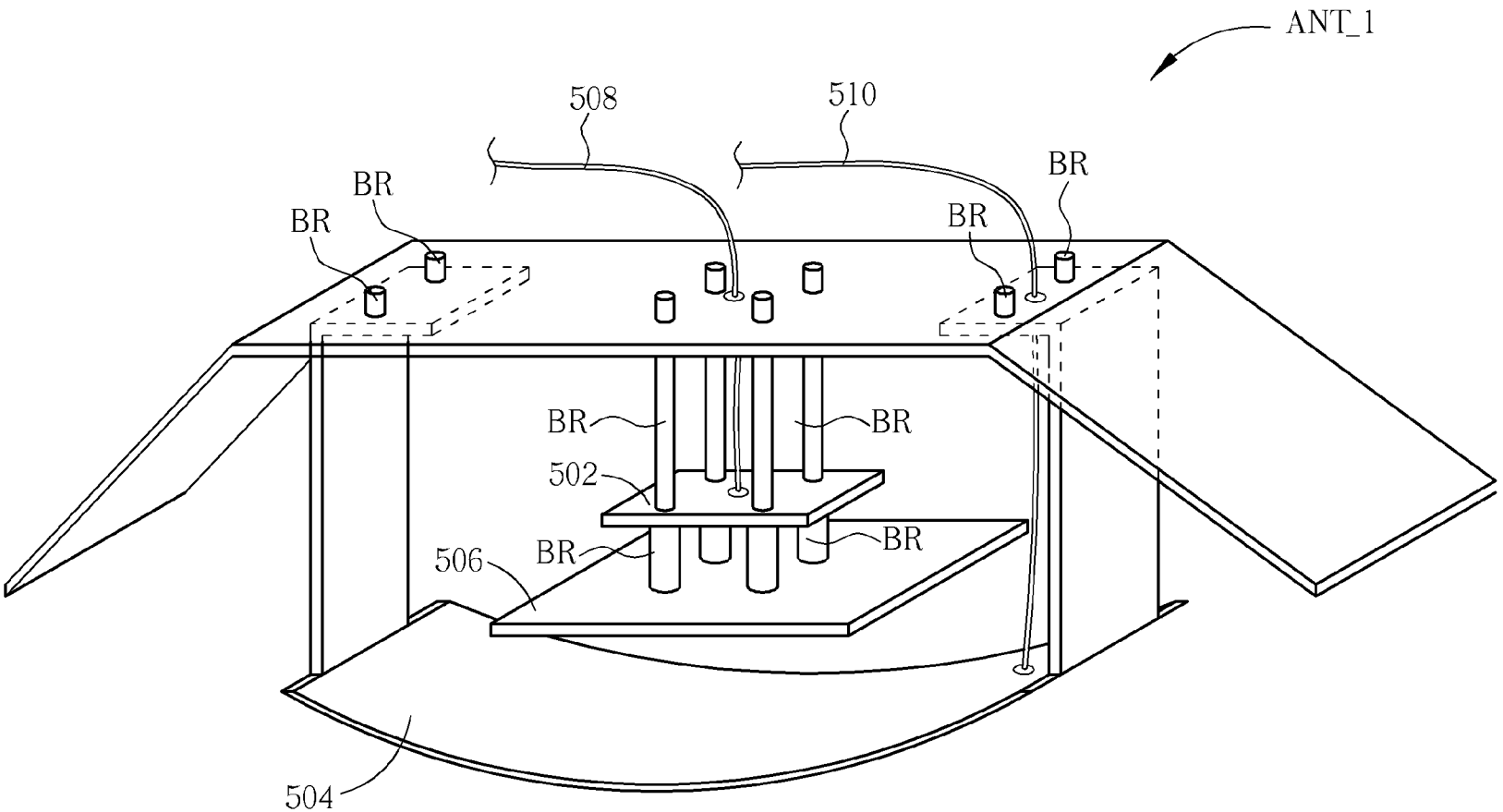

The aforementioned embodiments may be suitably modified to further derive an antenna accommodated for MIMO systems. Please refer to FIG. 4, which is a schematic diagram of a complex antenna 40 according to an embodiment of the present invention. The complex antenna 40 is formed by antennas ANT_1-ANT_4, a top plate PLT_TP and a bottom plate PLT_BT, and is accommodated for a MIMO system, e.g. LTE wireless communication system, IEEE 802.11n wireless local area network system, etc. In more detail, structures of the antennas ANT_1-ANT_4 may be identical or slightly different. The antennas ANT_1-ANT_4 share the same basic concept as the antenna 10 in FIGS. 1A, 1B or the antenna 30 in FIGS. 3A, 3B, i.e. the antennas ANT_1-ANT_4 are formed by multi-layered patch plates. Taking the antenna ANT_1 as an example, as shown in FIGS. 5A and 5B, the antenna ANT_1 includes a ground metal plate 500, a first patch plate 502, a second patch plate 504 and a third patch plate 506, a first feed-in wire 508, a second feed-in wire 510 and an insulation fixing unit formed by eight cylinders BR. The eight cylinders BR are for fixating the ground metal plate 500, the first patch plate 502, the second patch plate 504 and the third patch plate 506, such that they do not come in contact with each other, ensuring normal signal transmission or reception. Moreover, the ground metal plate 500 includes two bends, such that it appears to have two flanks, and serves to focus wave beams generated by the antenna ANT_1 within a predefined range. The second patch plate 504 also has multiple bends, aimed at reducing its expanded area (i.e. an area projected onto the ground metal plate 500). The first feed-in wire 508 and the second feed-in wire 510 are electrically connected to the first patch plate 502 and the second patch plate 504, respectively, for transmitting radio signals. The wire lengths of the first feed-in wire 508 and the second feed-in wire 510 are preferably integer multiples of the half wavelength. The third patch plate 506 is disposed between the first patch plate 502 and the second patch plate 504, for increasing the resonance bandwidth.

Figure 5C:
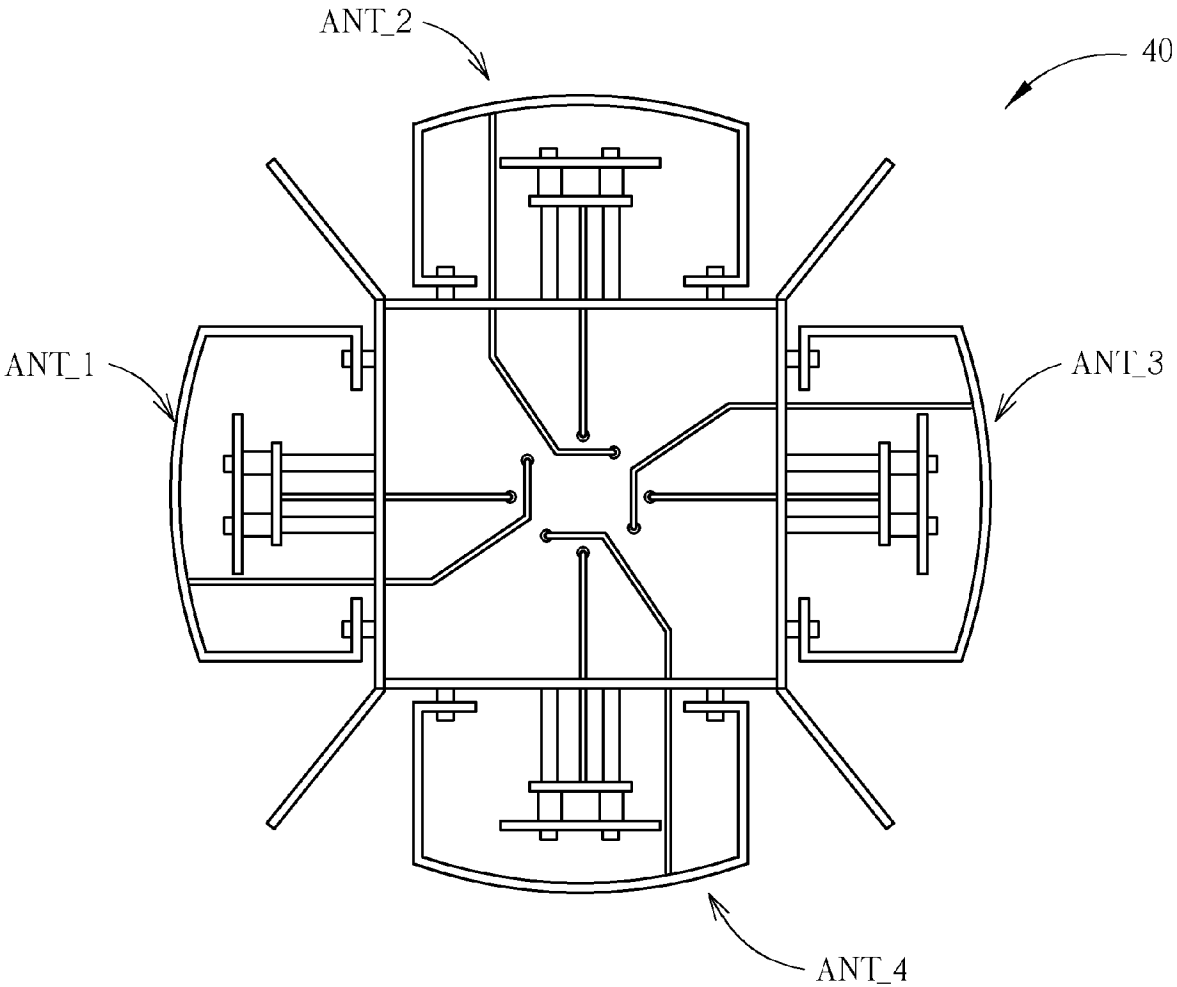
FIG. 5C is a cross-section schematic diagram of the complex antenna in FIG. 4.

Structures of the antennas ANT_2-ANT_4 are the same as that of the antenna ANT_1, and after combination, the complex antenna 40 forms a symmetric ring structure, as shown in FIG. 5C, which is a cross-section diagram of the complex antenna 40. Note that, in the complex antenna 40, the ground metal plates of the antennas ANT_1-ANT_4 are electrically connected, i.e. the antennas ANT_1-ANT_4 share a common ground. As such, it is possible to suitably adjust dimensions of the ground metal plates of the antennas ANT_1-ANT_4 to reduce manufacturing costs. For example, as shown in FIG. 5C, the ground metal plates of the antennas ANT_2, ANT_4 are only connected to the ground metal plates of the antennas ANT_1, ANT_3, omitting the two flanks. Obviously, it is possible for the antennas ANT_1-ANT_4 to all have identical structures, provided that their ground metal plates are all electrically connected to the same ground.

Figure 6:
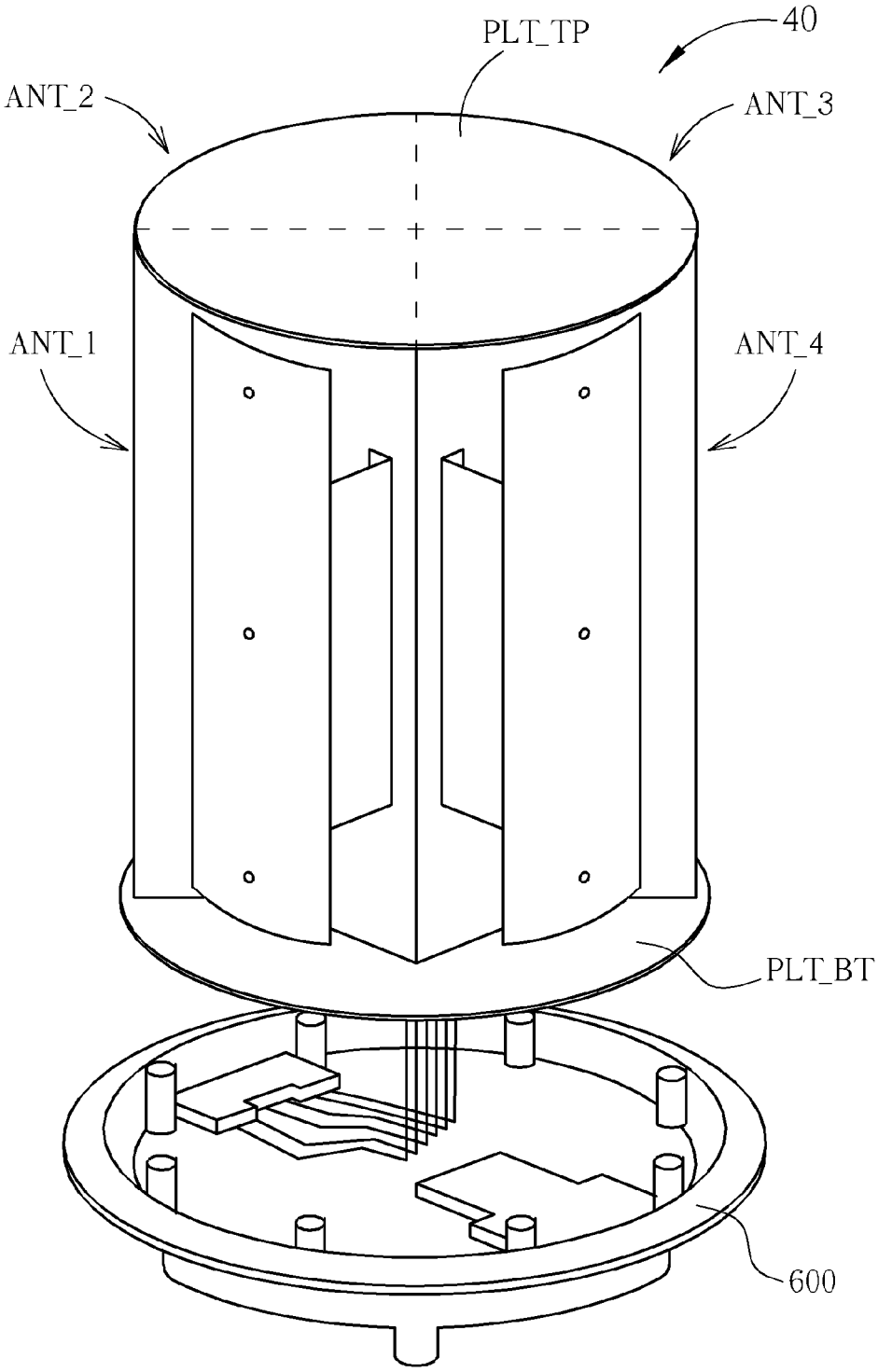
FIG. 6 is a schematic diagram of a switching circuit added to the complex antenna in FIG. 4.

On the other hand, as shown in FIG. 6, a switching circuit 600 is required to implement a radio-frequency transceiver system, in order to accommodate the complex antenna 40 for a MIMO system. The switching circuit 600 may be a diode circuit, single-pole, single-throw (SPST) switching circuit with power splitters, etc., and is electrically connected between the feed-in wires of the antennas ANT_1-ANT_4 and a radio-frequency signal processing module (not shown in FIG. 6). The switching circuit 600 is utilized for switching a connection between the radio-frequency signal processing module and each of the feed-in wires, to control a specific antenna of the antennas ANT_1-ANT_4 to be horizontally or vertically polarized, so as to correctly receive/transmit the radio signals. In this way, not only specific wave beams are generated via the complex antenna 40, but field patterns of adjacent antennas can also be synthesized into a new field pattern, to compensate for an attenuation of peak gain value of each individual antenna after deviating from the 45-degree angle.

For example, the LTE wireless communication system requires a resonance frequency from 746 MHz to 787 MHz for vertically polarized antennas, and a resonance frequency from 746 MHz to 756 MHz for horizontally polarized antennas. To implement such applications with a conventional planar antenna would require patch plates with dimensions matching the half wavelength in order to meet resonance requirements, i.e. about 20 cm at 746 MHz (electromagnetic waves have wavelengths of approx. 40 cm at 746 MHz). Adding the ground plane would lead to slightly larger dimensions, resulting in a total length of about 22 cm. For such an antenna to have both vertical and horizontal polarizations would lead to a dimension of 22 cm×22 cm. By placing the four antennas in a ring would result in an antenna height maintained at 22 cm, but the cylinder formed by the four antennas on the horizontal place would have a resulting radius of 15.5 cm. This would lead to rather bulky dimensions of the antenna. Additionally, a conventional microstrip antenna has a relative resonance bandwidth of 3% of the resonance frequency, whereas a vertically polarized antenna for LTE wireless communication system is required to have a resonance frequency centered at 766.5 MHz, with a bandwidth of 41 MHz, i.e. the relative resonance bandwidth is about 5.3% of the resonance frequency; a horizontally polarized antenna for LTE is required to have a resonance frequency centered at 751 MHz, with a bandwidth of 10 MHz, i.e. the relative resonance bandwidth is about 1.3% of the center resonance frequency. Obviously, for vertical polarizations, the conventional microstrip antenna does not meet bandwidth requirements.

On the contrary, when utilizing the complex antenna 40 to implement such applications, a radius of the complex antenna 40 may be set to 9 cm; then a resonance length along the vertical direction is maintained at 22 cm, while a resonance length along the horizontal direction is only 12.7 cm. However, via multiple bends on the horizontal place, the effective resonance length of the complex antenna 40 is increased due to generated parasitic electromagnetic fields, such that horizontal polarization shifts toward a lower frequency. Concurrently, the multi-layered microstrip structure of the complex antenna 40 can increase resonance bandwidth of the antenna, thereby also increasing degree of freedom for designing the antenna by facilitating adjustments of characteristics of the antenna.

Additionally, it can be decided whether the antennas ANT_1-ANT_4 are activated or shut down by utilizing the switching circuit 60. Consequently, an 8-way singular antenna wave beam may be obtained (wherein 4 ways are vertically polarized and 4 ways are horizontally polarized) and an 8-way synthesized antenna wave beam (wherein 4 ways are vertically polarized and 4 ways are horizontally polarized), equivalent to a total of a 16-way wave beam. Note that, when multiple antennas are positioned in close proximity of each other, energy radiated from a specific antenna would be absorbed by other adjoining antennas, reducing total radiation energy of the antenna. It is possible to compensate for the lost radiation energy by reflecting the absorbed energy from the adjoining antennas back to the original emitting antenna, and then radiate back into space; however, this subsequent radiation may have an electromagnetic wave phase difference with the original radiation, resulting in destructive interference and distorting the radiation field pattern of the original antenna. Therefore, in practical design, it should be ensured that the switching circuit 60 has total energy reflection characteristics when circuit is open. Concurrently, it is possible to control radiation phases of the adjoining, inactivated antennas by adjusting wire lengths of the feed-in wires, so as to obtain optimal antenna radiation characteristics.

Figure 7:
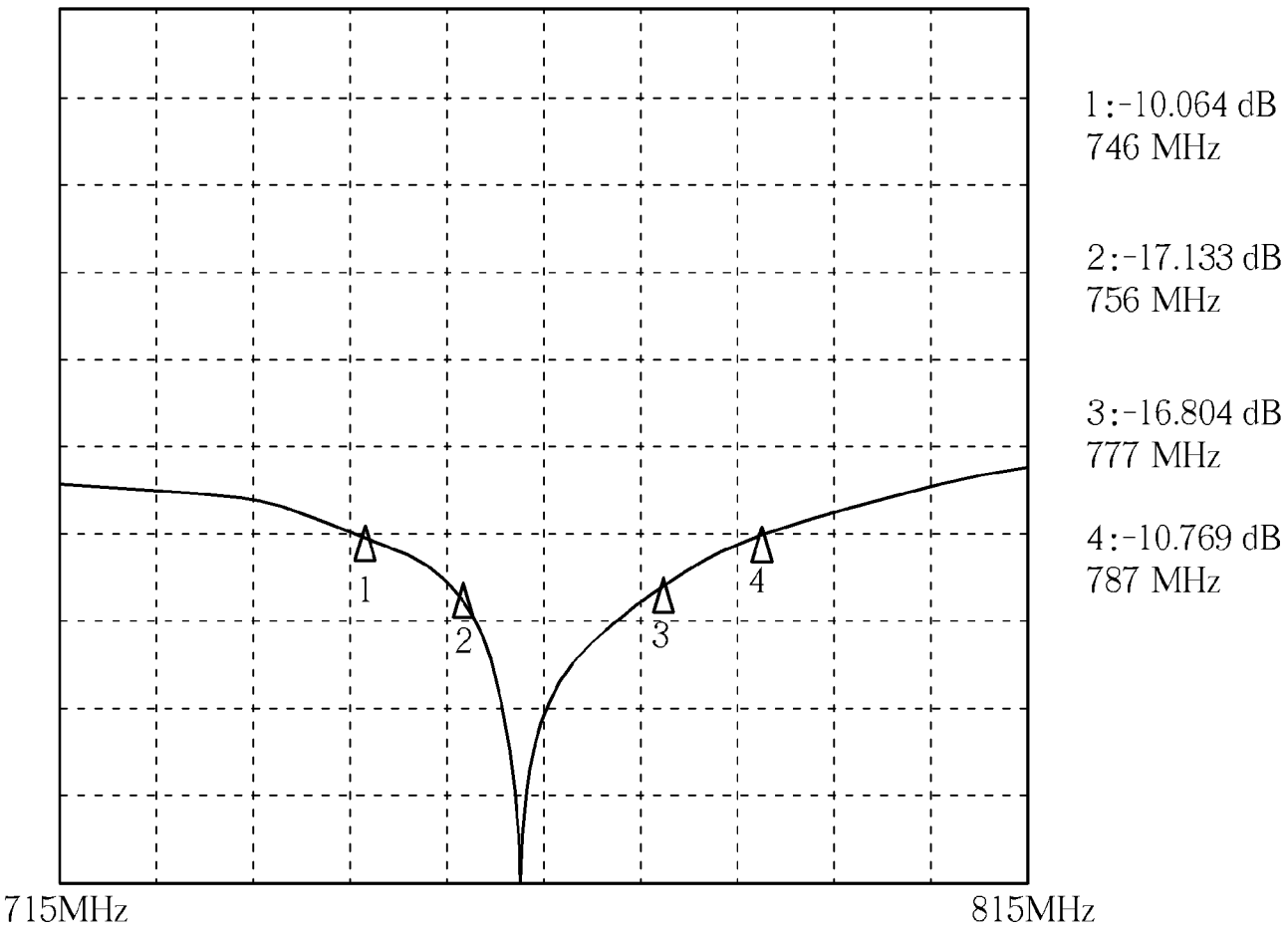
Figure 8:
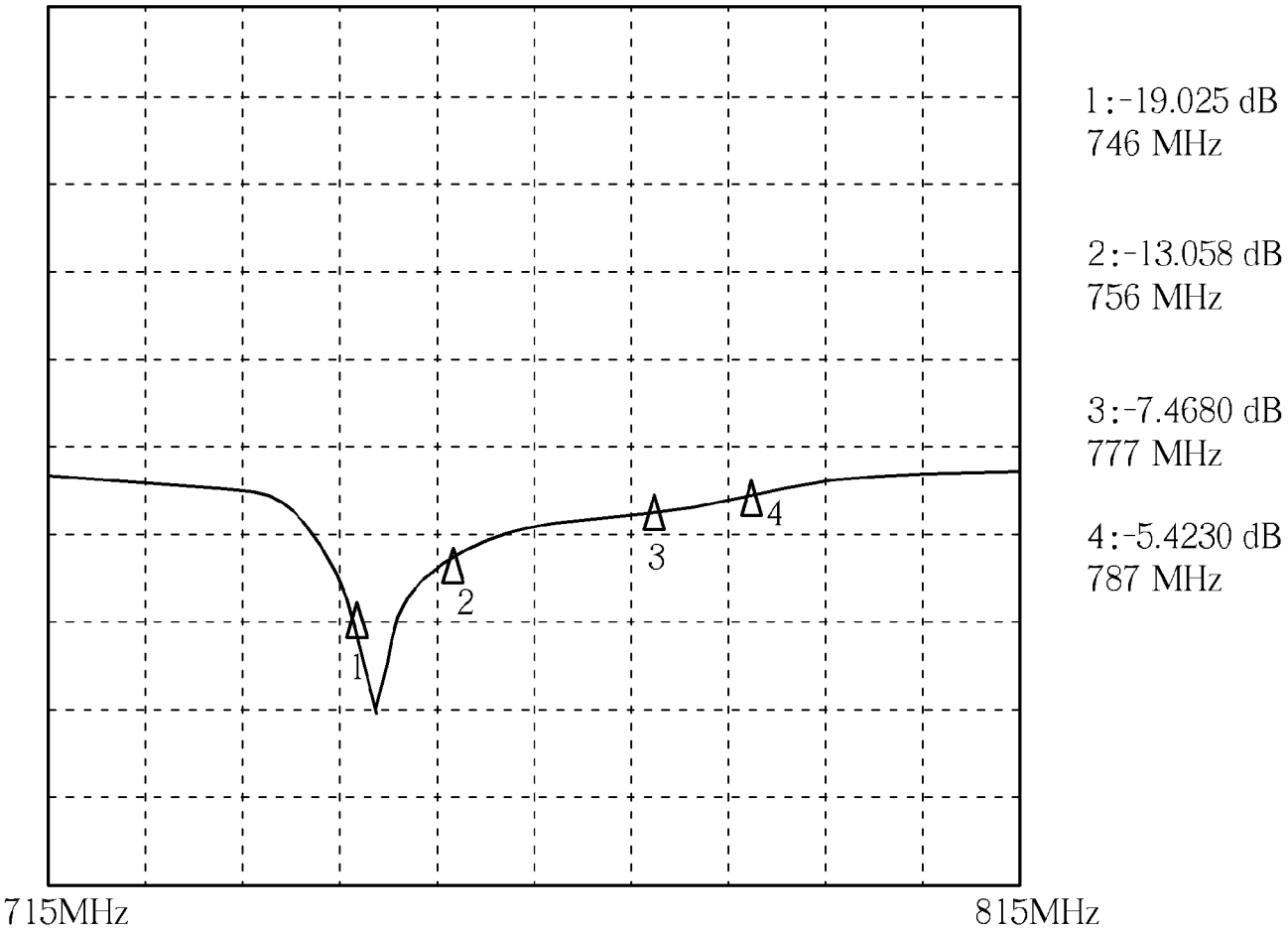
Figure 9:
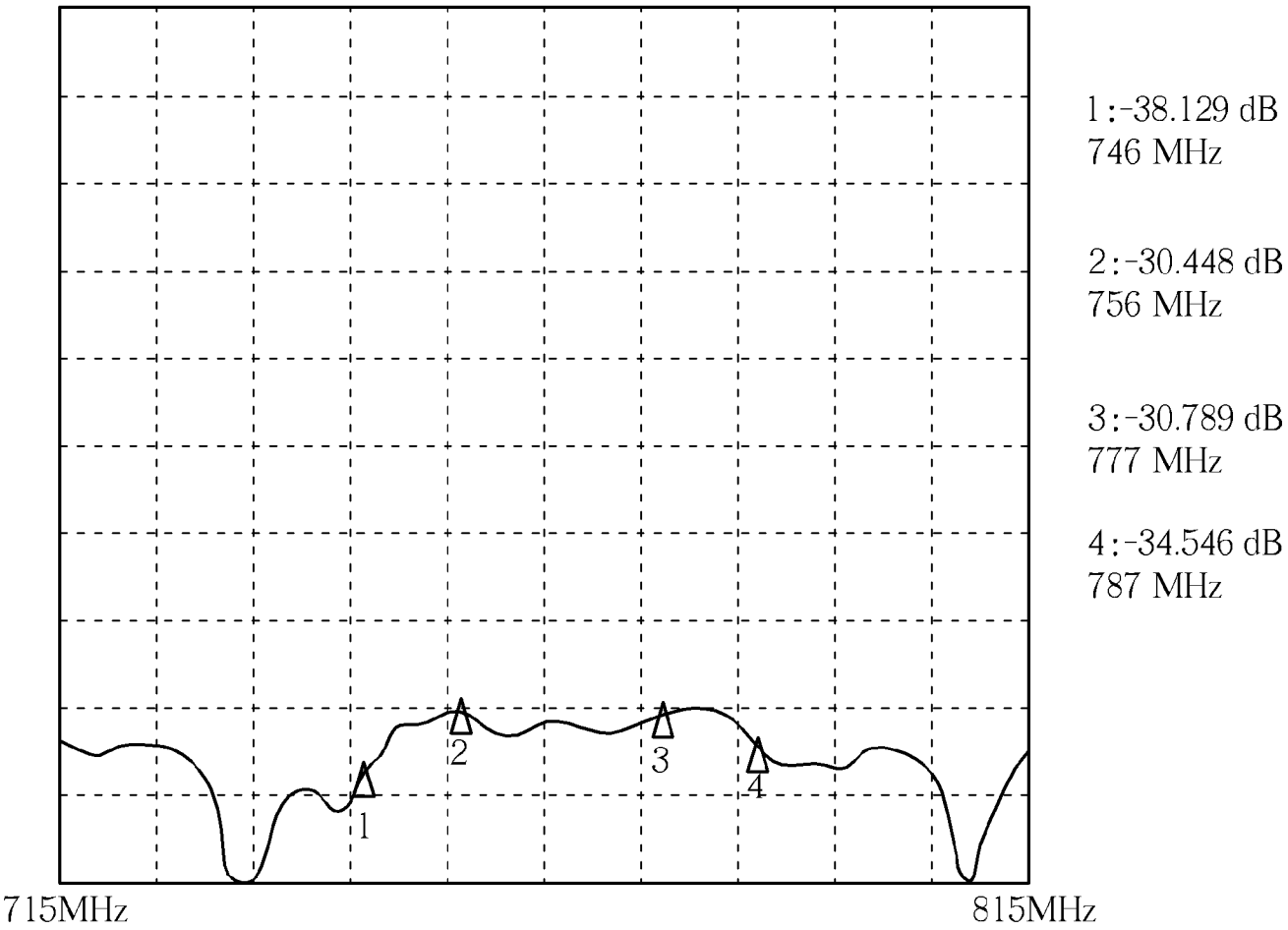

In more detail, please refer to FIGS. 7 to 13, which are schematic diagrams of measured characteristics of the complex antenna 40. Firstly, FIGS. 7 and 8 are schematic diagrams of vertically and horizontally polarized resonance of the complex antenna 40. As shown in FIG. 7, the vertically polarized resonance of the complex antenna 40 is below −10 dB from 746 MHz to 787 MHz, which is a considerably wide resonance bandwidth. The horizontally polarized resonance of the complex antenna 40, as shown in FIG. 8, is below −13 dB from 746 MHz to 756 MHz. In other words, the complex antenna 40 is capable of generating resonance within the required frequency range of the LTE wireless communication system. Furthermore, FIG. 9 is a schematic diagram of isolation between vertical polarization and horizontal polarization of the complex antenna 40, and it can be seen that an isolation between the two reaches 30 dB and above.

Moreover, FIG. 10 is a field pattern characteristic table for an arbitrary antenna of the antennas ANT_1-ANT_4, and FIG. 11 is a field pattern characteristic table for the antennas ANT_1-ANT_4 after being synthesized into the complex antenna 40. As can be shown by FIG. 10, a singular antenna of the antennas ANT_1-ANT_4 has a maximum gain value of at least 5.5 dBi, a 3 dB beam width of about 80 deg-110 deg (angular degree), a front-to-back ratio (i.e. ratio of a front peak value over a back peak value) of at least 10 dB, a Co/Cx ratio of at least 28 dB. As can be shown from FIG. 11, after the antennas ANT_1-ANT_4 are synthesized, the complex antenna 40 has a maximum gain value of at least 4.9 dBi, a 3 dB beam width of about 90 deg-120 deg, a front-to-back ratio of at least 11.6 dB, a Co/Cx ratio of at least 22 dB. It should be noted that these gain values of the complex antenna have already accounted for radiation energy loss in the switching circuit and the feed-in wires; if the loss is compensated for, the gain value of the antenna may reach 7-8 dBi.

Figure 12:
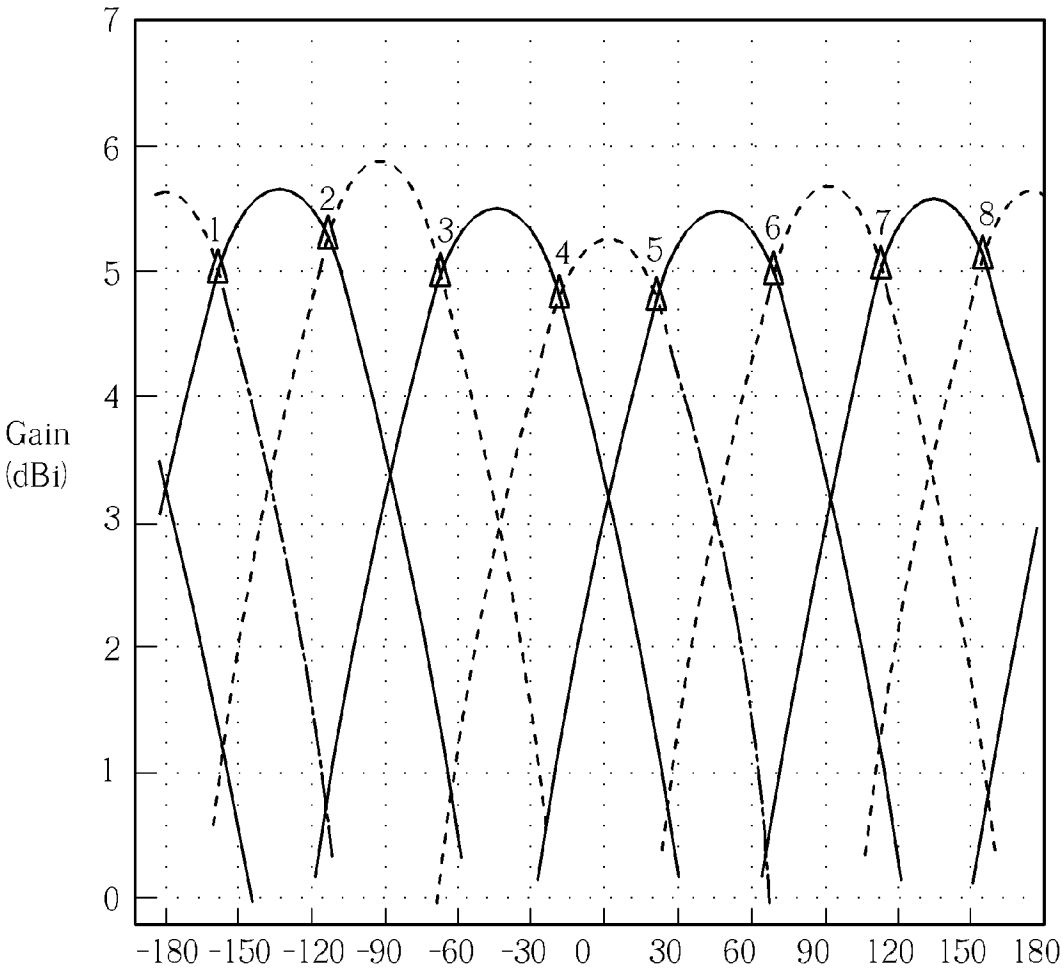
Figure 13:
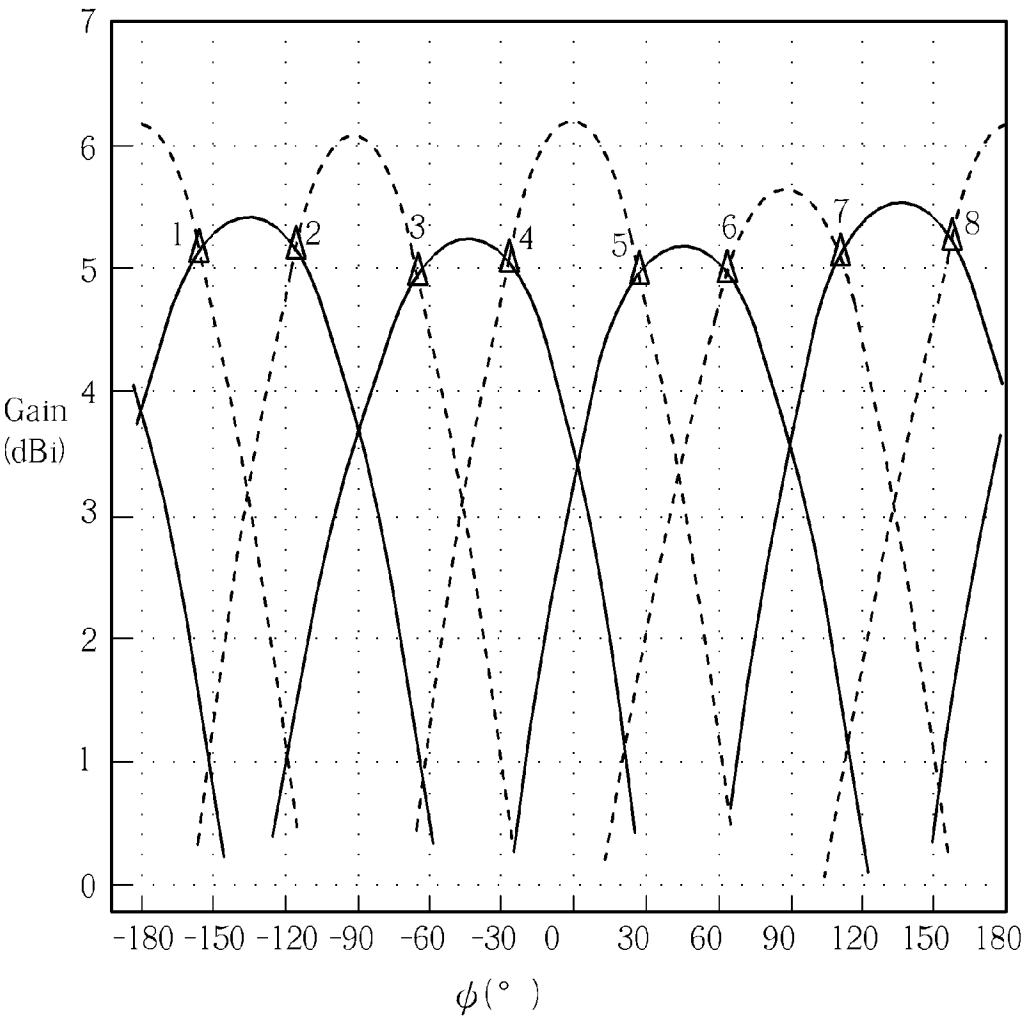

Finally, FIG. 12 is a field pattern schematic diagram of a vertically polarized wave beam of the complex antenna 40; and FIG. 13 is a field pattern schematic diagram of a horizontally polarized wave beam of the complex antenna 40. In FIG. 12, dotted lines denote singular antenna beams, with maximum gain values that attenuate to 3.0 dBi after leaving 45-degree angles; solid lines denote synthesized beams, with synthesized gain values back to 5.5 dBi; therefore, by combining singular and synthesized beams, it is possible for the vertically polarized wave beam to achieve a minimum gain value of 4.7 dBi, resulting in eight beams. Similarly, as shown in FIG. 13, dotted lines denote singular antenna beams, with maximum gain values that attenuate to 3.0 dBi after leaving 45-degree angles; solid lines denote synthesized beams, with synthesized gain values back to 5.2 dBi; therefore, by combining singular and synthesized beams, it is possible for the horizontally polarized wave beam to achieve a minimum gain value of 4.9 dBi. As can be seen, the complex antenna 40 can provide 16 different spatial channels, each channel having optimal antenna characteristics, meeting MIMO system requirements. In other words, the complex antenna 40 is capable of concurrently providing 16 optimal antenna beams on the horizontal plane, such that the system has optimal wave beam selection.

As mentioned above, a prerequisite for implementing spatial multiplexing and spatial diversity functionalities in a MIMO system is having multiple sets of antennas to divide space into many channels, and to provide multiple antenna field patterns; concurrently, spatial efficiency should be taken into consideration. In such a case, the complex antenna of the present invention is to arrange antennas side by side to form a circular ring antenna set with a common ground plane, to effectively utilize space. Concurrently, the complex antenna of the present invention is capable exciting a horizontally polarized electromagnetic wave along the horizontal direction with a needed frequency range, within a horizontal plane of limited space. The complex antenna of the present invention is also capable of utilizing multi-layered microstrip metal layers to increase resonance bandwidth and degree of freedom for designing the antenna. Moreover, utilizing multi-layer feed-in allows better isolation between the horizontal and vertical polarization; and suitably adjusting wire lengths can eliminate field pattern interference when antennas are in close proximity to each other. Furthermore, experimental results show that each individual antenna of the complex antenna of the present invention provides considerably high horizontal and vertical polarization gain values, and each antenna has a front-to-back ratio of at least 9 dB, and for horizontal and vertically polarized antennas, each antenna provides a 3 dB field pattern of equivalent to 80-120 deg, allowing maximum gain when adjoining antenna field patterns are combined.

The complex antenna 40 includes four antennas, and provides 16 different spatial channels. Note that, the complex antenna of the present invention is not limited to having four antennas, but rather can be suitably adjusted to have different number of antennas according to different application requirements.

In summary, the present invention utilizes multi-layered patch plate to implement horizontally and vertically polarized antennas; and increases spatial efficiency through suitably synthesizing the antennas to form a complex antenna, to effectively increase resonance bandwidth and degree of freedom for design, to accommodate MIMO applications.

Those skilled in the art will readily observe that numerous modifications and alterations of the device and method may be made while retaining the teachings of the invention.

What is claimed is:

1. An antenna for receiving and transmitting radio signals, comprising:

a ground metal plate;

a first patch plate;

a second patch plate;

a first feed-in wire, electrically connected to the first patch plate, for transmitting radio signals;

a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other;

wherein a result of projecting the first patch plate on the ground metal plate partially overlaps a result of projecting the second patch plate on the ground metal plate.

2. The antenna of claim 1, wherein the ground metal plate comprises at least a bend.

3. The antenna of claim 2, wherein the at least a bend of the ground metal plate is used for focusing a wave beam generated by the antenna within a predefined range.

4. The antenna of claim 1, wherein the first patch plate or the second patch plate comprises at least a bend.

5. The antenna of claim 4, wherein the at least a bend of the first patch plate or the second patch plate is used for reducing an area projected onto the ground metal plate by the first patch plate or the second patch plate.

6. The antenna of claim 1, further comprising a third patch plate, wherein the insulation fixing unit is further used for fixing the third patch plate between the first patch plate and the second patch plate, such that the first patch plate, the second patch plate and the third patch plate do not come in electrical contact with each other.

7. The antenna of claim 1, wherein wire lengths of the first feed-in wire and the second feed-in wire are related to half wavelengths of the radio signals transmitted.

8. A complex antenna for receiving and transmitting radio signals, comprising a plurality of antennas, each antenna comprising:

a ground metal plate;

a first patch plate;

a second patch plate;

a first feed-in wire, electrically connected to the first patch plate, for transmitting radio signals;

a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other;

wherein a result of projecting the first patch plate on the ground metal plate partially overlaps a result of projecting the second patch plate on the ground metal plate, and the ground metal plate of each of the plurality of antennas is electrically connected to the ground metal plate of another antenna.

9. The complex antenna of claim 8, wherein the ground metal plate of each of the plurality of antennas comprises at least a bend.

10. The complex antenna of claim 9, wherein the at least a bend of the ground metal plate of each of the plurality of antennas is for focusing a wave beam generated by each of the plurality of antennas within a predefined range.

11. The complex antenna of claim 8, wherein the first patch plate or the second patch plate of each of the plurality of antennas comprises at least a bend.

12. The complex antenna of claim 11, wherein the at least a bend of the first patch plate or the second patch plate of each of the plurality of antennas is used for reducing an area projected onto the ground metal plate by the first patch plate or the second patch plate.

13. The complex antenna of claim 8, wherein each of the plurality of antennas further comprises a third patch plate, and the insulation fixing unit is further used for fixing the third patch plate between the first patch plate and the second patch plate, such that the first patch plate, the second patch plate and the third patch plate do not come in electrical contact with each other.

14. The complex antenna of claim 8, wherein wire lengths of the first feed-in wire and the second feed-in wire of each of the plurality of antennas are related to half wavelengths of the radio signals transmitted.

15. A radio-frequency transceiver system for receiving and transmitting radio signals, comprising:

a complex antenna, comprising a plurality of antennas, each of the plurality of antennas comprising:

a ground metal plate;

a first patch plate;

a second patch plate;

a first feed-in wire, electrically connected to the first patch plate, for transmitting radio signals;

a second feed-in wire, electrically connected to the second patch plate, for transmitting radio signals; and an insulation fixing unit, for fixing the ground metal plate, the first patch plate and the second patch plate, such that the ground metal plate, the first patch plate and the second patch plate do not come in electrical contact with each other;

wherein a result of projecting the first patch plate on the ground metal plate partially overlaps a result of projecting the second patch plate on the ground metal plate, and the ground metal plate of each of the plurality of antennas is electrically connected to the ground metal plate of another antenna;

a radio-frequency signal processing module; and a switching circuit, electrically connected between the first feed-in wire, the second feed-in wire of each of the plurality of antennas and the radio-frequency signal processing module, for switching a connection between the radio-frequency signal processing module and the first feed-in wire or the second feed-in wire.

16. The radio-frequency transceiver system of claim 15, wherein the ground metal plate of each of the plurality of antennas comprises at least a bend.

17. The radio-frequency transceiver system of claim 16, wherein the at least a bend of the ground metal plate of each of the plurality of antennas is used for focusing a wave beam generated by each of the plurality of antennas within a predefined range.

18. The radio-frequency transceiver system of claim 15, wherein the first patch plate or the second patch plate of each of the plurality of antennas comprises at least a bend.

19. The radio-frequency transceiver system of claim 18, wherein the at least a bend of the first patch plate or the second patch plate of each of the plurality of antennas is used for reducing an area projected onto the ground metal plate by the first patch plate or the second patch plate.

20. The radio-frequency transceiver system of claim 15, wherein each of the plurality of antennas further comprises a third patch plate, and the insulation fixing unit is further used for fixing the third patch plate between the first patch plate and the second patch plate, such that the ground metal plate, the first patch plate and the second patch plate do not come in electrical contact with each other.

21. The radio-frequency transceiver system of claim 15, wherein wire lengths of the first feed-in wire and the second feed-in wire of each of the plurality of antennas are related to half wavelengths of the radio signals transmitted.

* * * * *